US005894944A

United States Patent [19]

Swift

[11] Patent Number: 5,894,944

[45] Date of Patent: Apr. 20, 1999

[54] TRAY

[76] Inventor: Lawrence F. Swift, 3539 W. Bear Lake Rd., Hillsdale, Mich. 49242

[21] Appl. No.: 08/906,928

[22] Filed: Aug. 6, 1997

[51] Int. Cl.[6] ..... A47F 5/00

[52] U.S. Cl. ..... 211/78; 211/128.1; 211/131.1; 211/133.4; D7/501

[58] Field of Search ..... 211/77, 78, 128.1, 211/129.1, 133.4, 131.1, 205; D7/615, 501, 552, 558

[56] References Cited

U.S. PATENT DOCUMENTS

D. 149,046 3/1948 Blumenthal et al. .
D. 160,688 10/1950 Brock .
D. 272,212 1/1984 Daemen et al. .
D. 291,635 9/1987 Dickman .
2,101,401 12/1937 Leppke .
3,526,335 9/1970 Swett et al. .
4,678,089 7/1987 Lang ..... 211/133.4
5,277,488 1/1994 Cleary et al. ..... 211/131.1

*Primary Examiner*—Robert W. Gibson, Jr.
*Attorney, Agent, or Firm*—Young & Basile, P.C.

[57] ABSTRACT

A serving tray having multiple levels includes a lower tray, a tapered collar, a cylindrical extension and an upper tray. The lower tray has a receiving cup having a ribbed exterior surface for alignment to one end of the tapered collar in a non-rotatable manner. The cylindrical extension is sized to fit through the other end of the collar and into the receiving cup such that rotatable movement of the extension is permitted. The upper tray has a centrally located cup with a vertical wall that extends below the planar surface of the upper tray and fits within the upper end of the extension so that the upper tray rotates with the extension.

5 Claims, 2 Drawing Sheets

TRAY

FIELD OF THE INVENTION

The present invention relates to a two tier serving tray.

BACKGROUND OF THE INVENTION

Trays having a tiered formation are well known in the art. Multi-tiered trays provide a means for serving a number of food products by using minimal table space. Storage space is also kept to a minimum in a refrigerator compartment when using a tiered tray apparatus. Another advantage of the multi-tiered tray includes handling and delivery of delicatessen trays for carryout purposes. For use in deli handling, it is preferred that the tiers, although may be releasibly stacked upon each other, they are secured when connected together. This is especially necessary for carryout deli trays when being handled by customers or the general public. It is further desirable to have trays that may be either stacked or used as well individually.

SUMMARY OF THE INVENTION

The invention relates to a two-tier tray having a cylindrical stem extending between the lower tray and the upper tray. A collar or base connects to the lower tray in a keyed configuration and stabilizes the lower tray to the cylindrical stem to create a more rigid two-tier tray structure.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
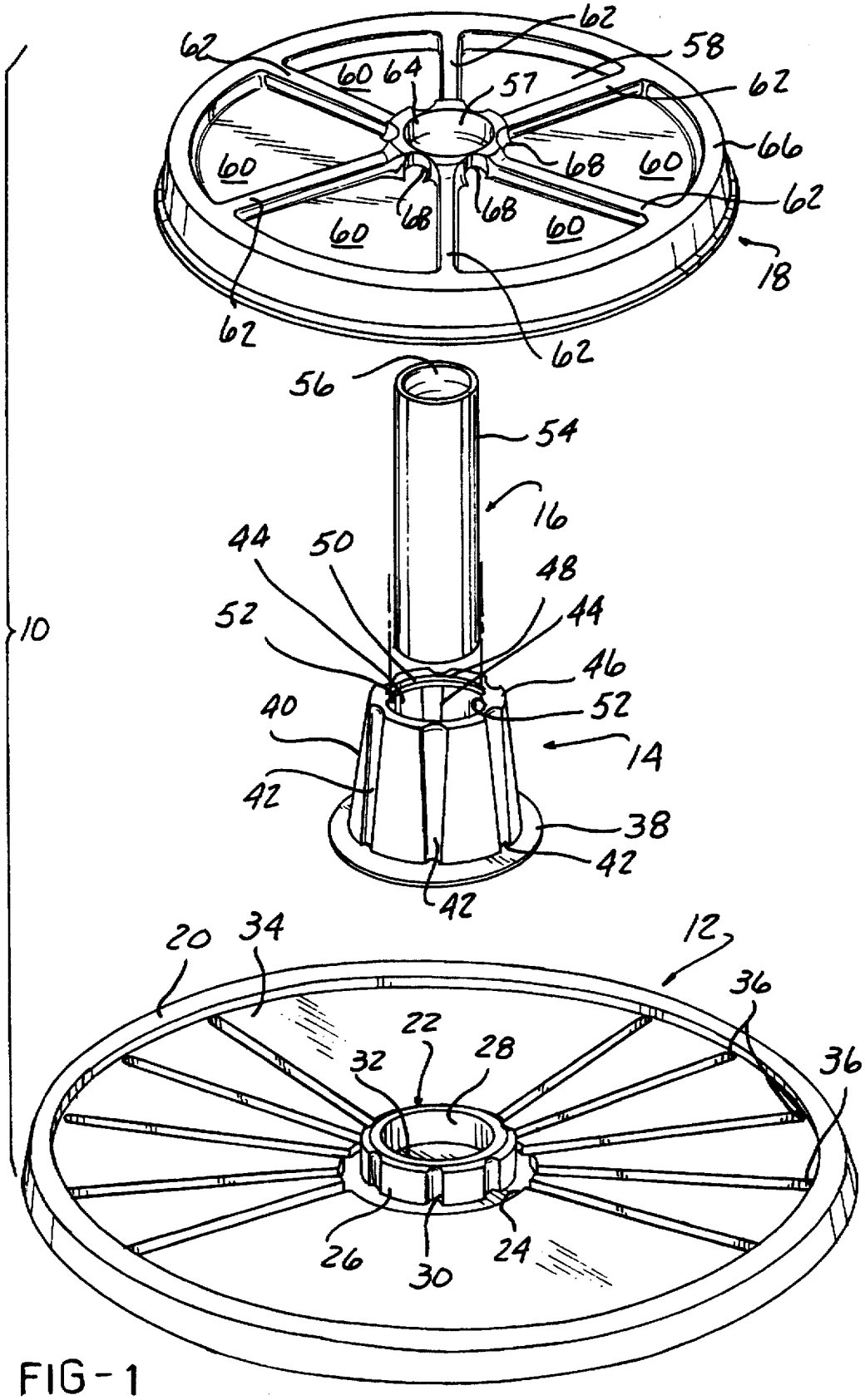
FIG. 1 is an exploded perspective view of a multi-tier tray according to the invention.
Figure 2:
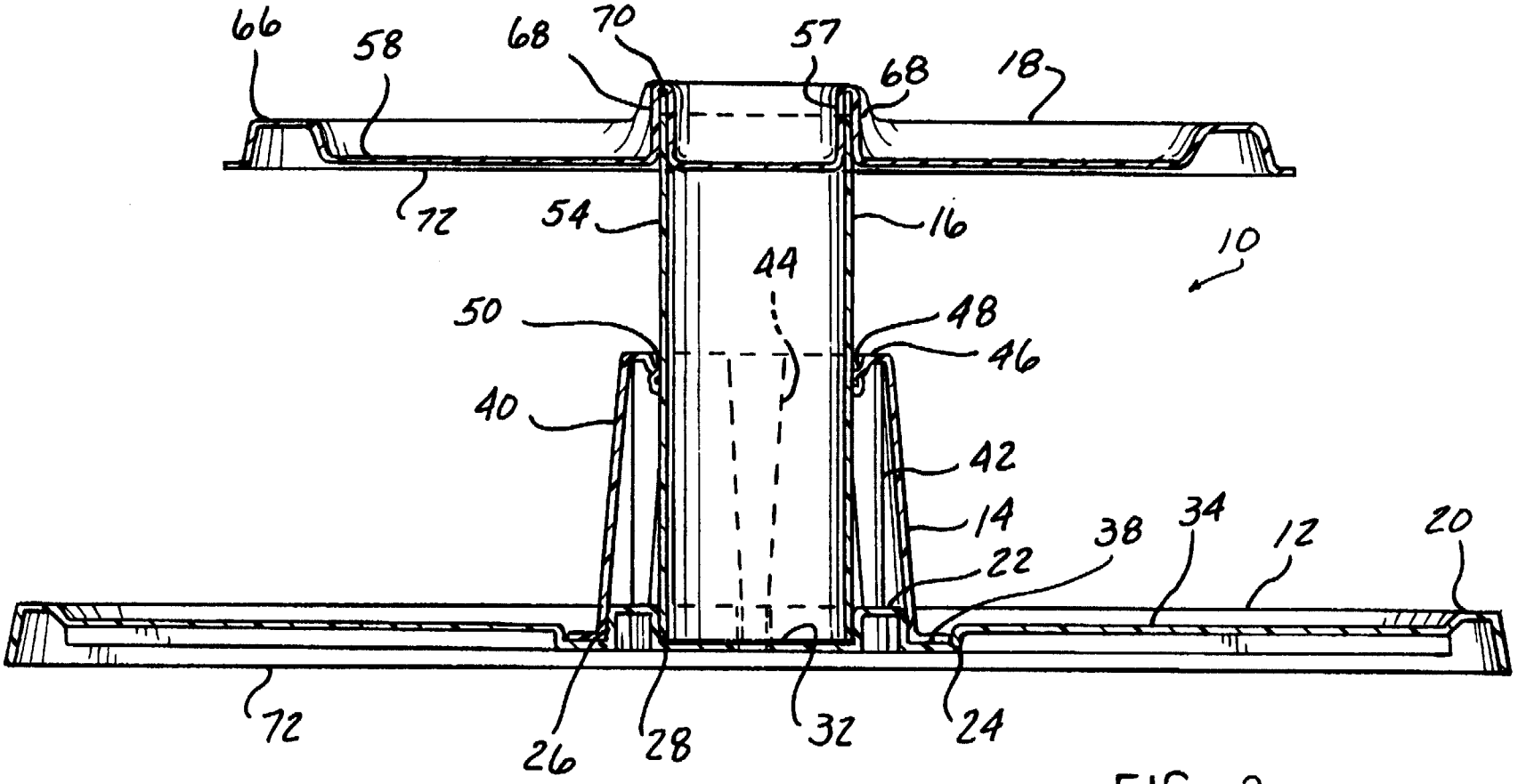
FIG. 2 is a cross-sectional side view of the tray.

Looking at FIGS. 1 and 2, the two-tiered serving tray 10 of the present invention includes four connectible components preferably made of a lightweight plastic material. The four components include a lower tray 12, a collar or guide portion 14, a cylindrical stem 16, and an upper tray 18. The lower tray 12 has a circular configuration with an elevated annular rim 20 along its peripheral edge. The lower tray 12 also includes a centrally located circular hub 22 for receiving the guide or collar 14. The circular hub 22 of the lower tray 12 has an annular recess 24 adjacent a protruding portion of the hub 22. The annular recess 24 provides a contained surface for receiving a portion of the collar 14. The protruding portion of the hub 22 includes a ring portion 26 having a smooth inner surface 28 and a grooved outer surface 30. Within the ring portion 26 is a planar surface 32. The internal planar surface 32 is on the same plane as the annular recess 24. A usable planar surface 34 surrounds the hub 22 of the lower tray 12 and is at a stepped up level from the annular recess 24. To provide added strength to the lower tray 12, the usable planar surface 34 may include radial grooves 36 that extend from the annular recess 24 to the annular rim 20.

The second component of the two-tiered tray 10 is an open-ended guide or collar 14 having an annular flat flange or rim 38 at one end. The annular flange 38 is sized to fit snugly within the confines of the annular recess 24. Collar 14 further includes an annular wall 40 that extends above flange 38 and slightly tapers inwardly having its widest end at flange 38. The annular wall portion 40 of the collar 14 has grooves 42 extending along its axial length and spaced around the perimeter of the collar 14. The collar 14 is made of thin plastic material so that the grooves 42 formed on the outer wall surface 40 of the collar 14 form corresponding ribs 44 on the inner surface of the annular wall 40. When the collar 14 is placed on the lower tray 12, the annular flange 38 fits tightly within annular recess 24. The ribs 44 formed on the inner surface of the annular wall 40 are spaced to coincide with the grooved outer surface 30 of the ring portion 26 on lower tray 12. Therefore, the collar 14 must be installed onto the lower tray 12 by aligning the ribs 44 with the grooves 30. This alignment prevents rotation of the collar 14 with respect to the lower tray 12. At the opposite end 46 of the collar 14 from the annular flange 38, the material forms an inturned annular lip 48 having an annular rib 50 and a pair of vertical protuberances 52 thereon. The inturned lip 48 with annular rib 50 and protuberances 52 help to center and maintain stem 16 in a vertical direction.

The third component of the two-tiered tray 10 is the straight cylindrical stem 16. The cylindrical stem 16 has open ends and has a height that defines the distance or space between the bottom tray 12 from the top tray 18. When installed, one end of stem 16 rests against the planar surface 32 within ring portion 26 of the lower tray 12. The cylindrical stem 16 has a diameter such that it snugly fits within the smooth inner surface 28 of hub 22 at one end and also within the internal annular lip 48. The cylindrical stem 16 has a smooth outer surface 54 so that it may rotate within the aforementioned surfaces. The collar 14 fits over the stem 16 as shown in FIG. 2 and provides added support to the stem 16 at the lower tray 12 location.

The upper tray 18 has a centrally located cup 64 having a vertical wall 57 that tightly fits against the top opening 56 of the cylindrical stem 16. The planar surface 58 of the upper tray 18 is subdivided into pie shaped sections by spaced ribs 62 extending radially from the centrally positioned cup 64 and terminating at a peripheral ledge 66. The ribs 62 provide strength to the tray 18 as well as providing sections for isolating individual food products from each other. The vertex of each pie shaped section has an indentation or dimple 68 so that an annular groove 70 is formed between the vertical wall 57 of cup 64 and indentations 68. The annular groove 70 holds the cylindrical stem 16 so that the upper tray 18 is held horizontally in place and cannot tip away from the cylindrical stem 16 and lower tray 12.

Each tray provides a flat bottom surface 72 so that each tray may be used individually for placement on a table or be used in combination to form the multi-tiered tray 10 as described. This is especially beneficial for delicatessens which can provide three order sizes with two trays that are easily transported by the customer. The large lower tray 12 and smaller upper tray 18 may be each used separately. Then for larger customer orders, the two trays may be combined to provide the tiered tray configuration. This configuration also reduces inventory for the delicatessen owner.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A serving tray having multiple levels comprising:

a lower tray having a centrally located receiving cup and an annular recess surrounding said cup, a cylindrical collar having a flange extending circumferentially from one end of said collar and an open second end, said flange sized for tightly fitting within the annular recess of said lower tray, a cylindrical extension having a pair of ends; and an upper tray having a centrally located cup forming an annular groove, wherein said receiving cup of the lower tray is configured for securely receiving one end of the cylindrical extension and said annular groove of the upper tray is configured for securely receiving the other end of the cylindrical extension.

2. The serving tray of claim 1, wherein said lower tray has a planar surface having strengthening ribs thereon.

3. The serving tray of claim 1, wherein said centrally located receiving cup has a ribbed outer wall.

4. The serving tray of claim 3, wherein the cylindrical collar has a ribbed inner wall which coincide with the ribbed outer wall of the receiving cup when said collar is connected to the lower tray.

5. The serving tray of claim 1, wherein the upper tray has a partitioned planar surface.

* * * * *